US006916088B2

(12) United States Patent
Smith et al.

(10) Patent No.: US 6,916,088 B2
(45) Date of Patent: Jul. 12, 2005

(54) INK CONTAINER CONFIGURED TO ESTABLISH RELIABLE FLUIDIC CONNECTION TO A RECEIVING STATION

(75) Inventors: Mark A. Smith, Corvallis, OR (US); John L. Taylor, Corvallis, OR (US); David R. Otis, Jr., Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/839,385

(22) Filed: Apr. 20, 2001

(65) Prior Publication Data

US 2002/0154199 A1 Oct. 24, 2002

(51) Int. Cl.[7] ..... B41J 2/175
(52) U.S. Cl. ..... 347/86
(58) Field of Search ..... 347/19, 50, 85–87

(56) References Cited

U.S. PATENT DOCUMENTS

| | | | | | |
|---|---|---|---|---|---|
| 5,085,698 | A | * | 2/1992 | Ma et al. | 524/388 |
| 5,552,816 | A | | 9/1996 | Oda et al. | 347/86 |
| 5,619,237 | A | | 4/1997 | Inoue et al. | 347/86 |
| 5,619,239 | A | | 4/1997 | Kotaki et al. | 347/86 |
| 5,784,088 | A | | 7/1998 | Ujita et al. | 347/86 |
| 5,883,653 | A | | 3/1999 | Sasaki | |
| 6,033,063 | A | | 3/2000 | Tomikawa et al. | |
| 6,039,441 | A | * | 3/2000 | Tomikawa et al. | 347/86 |
| 6,361,157 | B1 | * | 3/2002 | Petersen et al. | 347/85 |
| 6,471,321 | B1 | * | 10/2002 | Aono et al. | 347/14 |
| 6,502,917 | B1 | * | 1/2003 | Shinada et al. | 347/19 |
| 6,572,214 | B2 | * | 6/2003 | Otis et al. | 347/23 |
| 6,644,796 | B2 | * | 11/2003 | Olsen | 347/93 |
| 6,789,883 | B2 | * | 9/2004 | Heim et al. | 347/85 |

FOREIGN PATENT DOCUMENTS

| | | |
|---|---|---|
| EP | 0861733 A2 | 9/1998 |
| EP | 0949080 A2 | 10/1999 |
| HU | P0204548 | 10/2000 |
| HU | P0301066 | 1/2001 |
| HU | P0301088 | 1/2001 |

* cited by examiner

*Primary Examiner*—Michael Nghiem
(74) *Attorney, Agent, or Firm*—Kevin Sullivan

(57) ABSTRACT

The present disclosure relates to a replaceable ink container for providing ink to an inkjet printing system. The inkjet printing system is of the type having a receiving station for receiving the replaceable ink container. The receiving station has a fluid inlet and a sealing structure. The replaceable ink container includes a reservoir defining a fluid outlet and a sealing surface proximate the fluid outlet. The replaceable ink container also includes a sealing material contained within the reservoir for wetting the sealing surface to seal defects between the sealing surface and the sealing structure.

19 Claims, 11 Drawing Sheets

INK CONTAINER CONFIGURED TO ESTABLISH RELIABLE FLUIDIC CONNECTION TO A RECEIVING STATION

BACKGROUND OF THE INVENTION

The present invention relates to ink containers for providing ink to inkjet printers. Inkjet printers frequently make use of an inkjet printhead mounted on a carriage that is moved back and forth across print media, such as paper. As the printhead is moved across the print media, a control system activates the printhead to deposit or eject ink droplets onto the print media to form images and text. Ink is provided to the printhead by a supply of ink that is either carried by the carriage or mounted to the printing system so as not to move with the carriage.

For the case where the ink supply is not carried with the carriage, the ink supply can be in continuous fluid communication with the printhead by the use of a conduit to replenish the printhead continuously. Alternatively, the printhead can be intermittently connected with the ink supply by positioning the printhead proximate to a filling station that facilitates connection of the printhead to the ink supply.

For the case where the ink supply is carried with the carriage, the ink supply may be integral with the printhead, whereupon the entire printhead and ink supply is replaced when ink is exhausted. Alternatively, the ink supply can be carried with the carriage and be separately replaceable from the printhead. For the case where the ink supply is separately replaceable, the ink supply is replaced when exhausted, and the printhead is replaced at the end of printhead life. Regardless of where the ink supply is located within the printing system, it is critical that the ink supply provide a reliable supply of ink to the inkjet printhead.

There is an ever present need for ink supplies which make use of low cost materials and are relatively easy to manufacture, thereby reducing ink supply cost that tends to reduce the per page printing costs. In addition, these ink containers should be volumetrically efficient to produce a relative compact ink supply for reducing the overall size of the printing system. In addition, these ink supplies should be capable of being made in different form factors so that the size of the printing system can be optimized. Finally, these ink supplies should be capable of forming a reliable fluid connection with the printing system upon insertion into the printing system. This fluid connection should reduce the evaporation of water and other volatile ink components and minimize entry of air and contaminants from the ink delivery system.

SUMMARY OF THE INVENTION

One aspect of the present invention is a replaceable printing component for an inkjet printing system configured for receiving the replaceable printing component. The inkjet printing system has a fluid inlet and a sealing structure. The replaceable printing component includes a sealing surface configured for engaging a corresponding sealing structure on the inkjet printing system. The sealing surface is configured so that sealing material that wets the sealing surface seals defects between the sealing surface and the sealing structure.

Another aspect of the present invention is a replaceable ink container for providing ink to an inkjet printing system. The inkjet printing system is of the type having a receiving station for receiving the replaceable ink container. The receiving station has a fluid inlet and a sealing structure. The replaceable ink container includes a reservoir defining a fluid outlet and a sealing surface proximate the fluid outlet. The replaceable ink container also includes a sealing material contained within the reservoir for wetting the sealing surface to seal defects between the sealing surface and the sealing structure.

In one preferred embodiment, the sealing material is a pigmented ink. The pigmented ink when dried solidifies between the sealing surface and the sealing structure.

BRIEF DESCRIPTION OF THE DRAWINGS

FIG. 11 is a graphical representation of a sealing percentage versus defect size for the seal formed between the sealing surface and the ink container with the sealing material disposed there between.

DETAILED DESCRIPTION OF THE PREFERRED EMBODIMENTS

Figure 1:
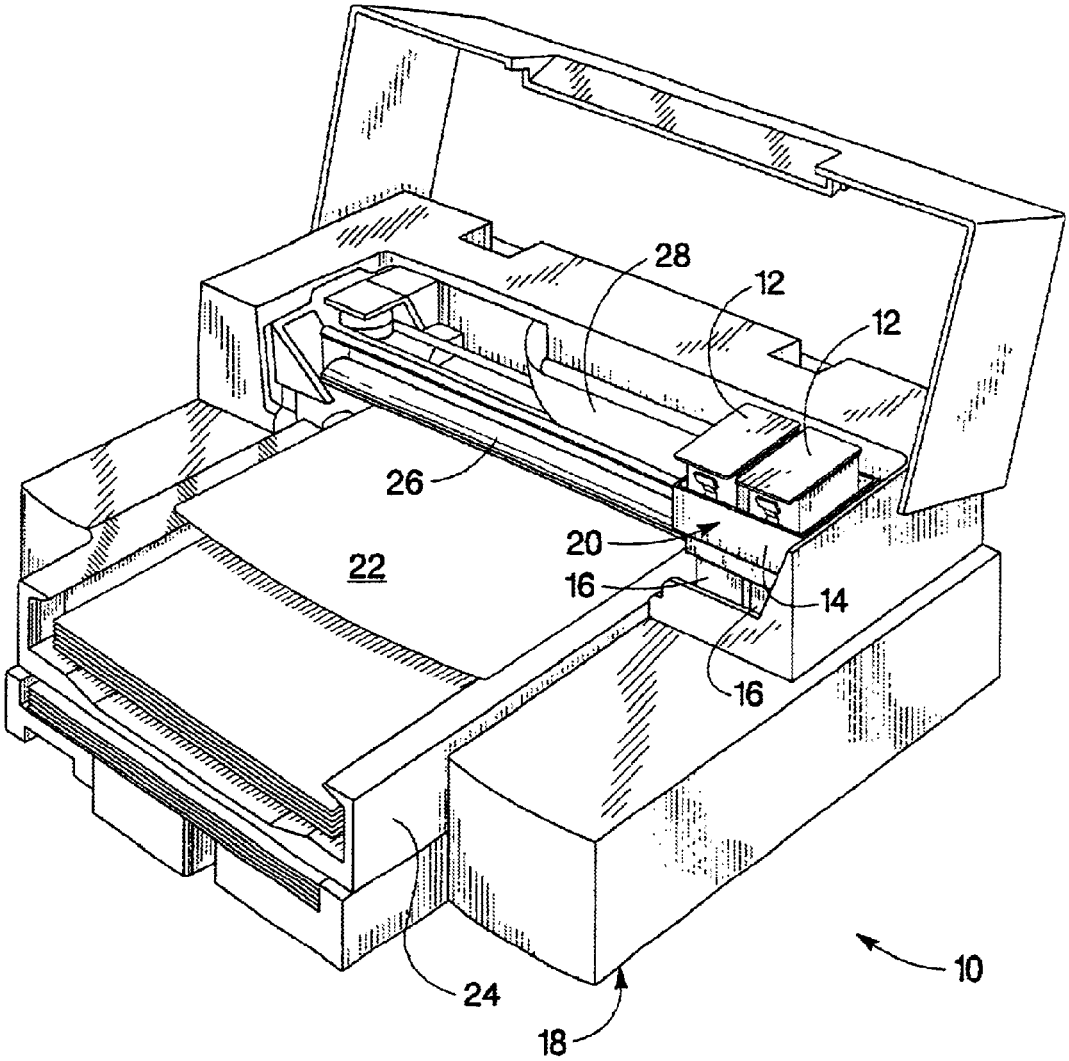
FIG. 1 is one exemplary embodiment of an ink jet printing system of the present invention shown with a cover opened to show a plurality of replaceable ink containers of the present invention.

FIG. 1 is a perspective view of one exemplary embodiment of a printing system 10, shown with its cover open, that includes at least one replaceable ink container 12 that is installed in a receiving station 14. With the replaceable ink container 12 properly installed into the receiving station 14, ink is provided from the replaceable ink container 12 to at least one ink jet printhead 16. The ink jet printhead 16 includes a small ink reservoir and an ink ejection portion that is responsive to activation signals from a printer portion 18 to deposit ink on print media. As ink is ejected from the printhead 16, the printhead 16 is replenished with ink from the ink container 12.

In an illustrative embodiment, the replaceable ink container 12, the receiving station 14, and the ink jet printhead 16 are each part of a scanning print carriage 20 that is moved relative to a print media 22 to accomplish printing. Alternatively, the ink jet printhead 16 is fixed and the print media is moved past the printhead 16 to accomplish printing. The printer portion 18 includes a media tray 24 for receiving print media 22. As print media 22 is stepped through the print zone, the scanning carriage moves the printhead 16 relative to the print media 22. The printer portion 18 selectively activates the printhead 16 to deposit ink on print media 22 to thereby accomplish printing.

The scanning carriage 20 is moved through the print zone on a scanning mechanism, which includes a slider rod 26 on which the scanning carriage 20 slides as the scanning carriage 20 moves through a scan axis. A positioning means (not shown) is used for precisely positioning the scanning carriage 20. In addition, a paper advance mechanism (not shown) is used to step the print media 22 through the print zone as the scanning carriage 20 is moved along the scan axis. Electrical signals are provided to the scanning carriage 20 for selectively activating the printhead 16 by means of an electrical link such as a ribbon cable 28.

A method and apparatus is provided for inserting the ink container 12 into the receiving station 14 such that the ink container 12 forms proper fluidic and electrical interconnect with the printer portion 18. The fluidic interconnection allows a supply of ink within the replaceable ink container 12 to be fluidically coupled to the printhead 16 for providing a source of ink to the printhead 16. The electrical interconnection allows information to be passed between the replaceable ink container 12 and the printer portion 18. Information passed between the replaceable ink container 12 and the printer portion 18 can include information related to the compatibility of replaceable ink container 12 with printer portion 18 and operation status information such as the ink level information, to name some examples.

One aspect of the present invention is a fluid interconnection technique that reduces the loss of water and other volatile ink components, and minimizes air transfer into the ink delivery system. This technique as will be discussed in more detail with respect to FIGS. 8–11, makes use of a sealing material carried with the ink container to seal imperfections in a sealing member thereby limiting loss of volatiles in the ink. The sealing material reduces the effect of contamination on sealing surfaces to increase seal robustness. By preventing loss of volatiles in the ink the reliability of printing system is improved.

Figure 2:
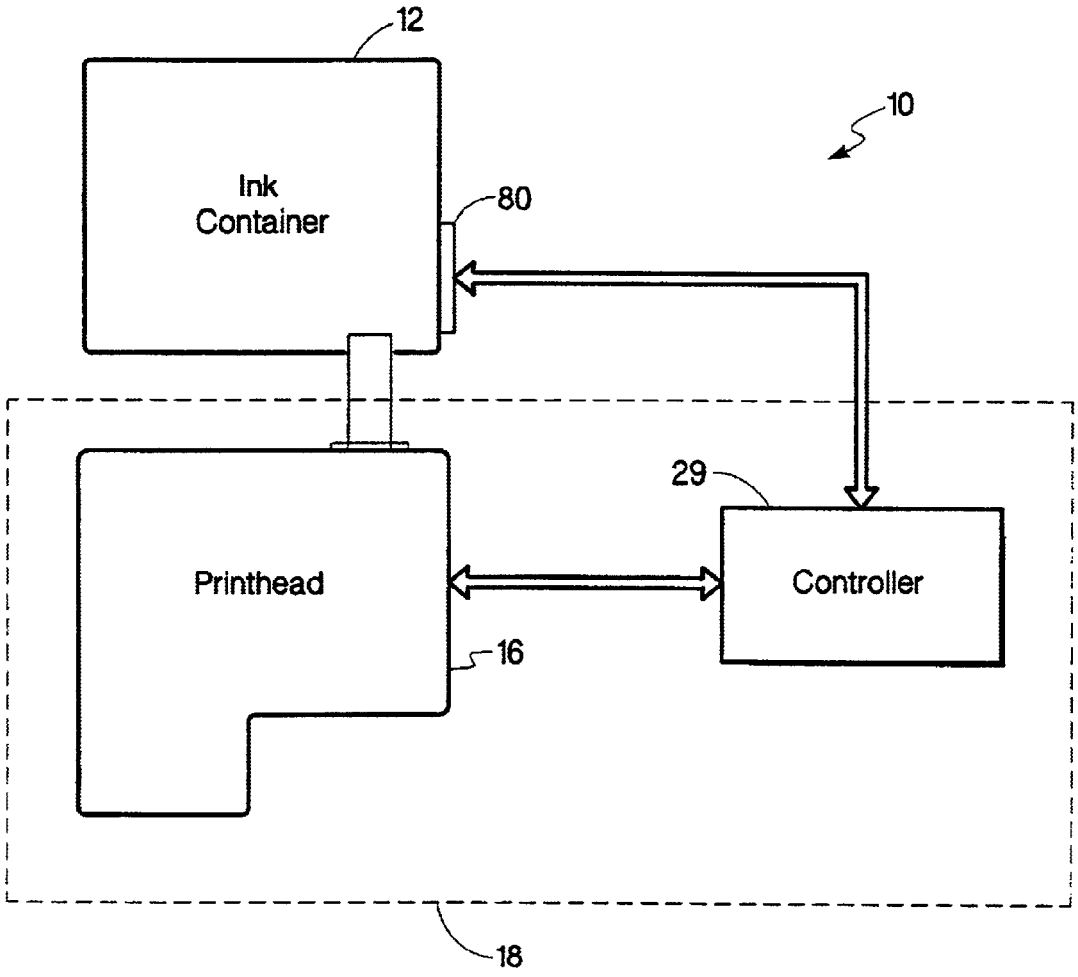
FIG. 2 is a schematic representation of the inkjet printing system shown in FIG. 1.

FIG. 2 is a simplified schematic representation of the inkjet printing system 10 shown in FIG. 1. FIG. 2 is simplified to illustrate a single printhead 16 connected to a single ink container 12. The ink-jet printing system 10 includes the printer portion 18 and the ink container 12, which is configured to be received by the printer portion 18. The printer portion 18 includes the inkjet printhead 16 and a controller 29. With the ink container 12 properly inserted into the printer portion 18, an electrical and fluidic coupling is established between the ink container 12 and the printer portion 18. The fluidic coupling allows ink stored within the ink container 12 to be provided to the printhead 16. The electrical coupling allows information to be passed between an electrical storage device 80 disposed on the ink container 12 and the printer portion 18. The exchange of information between the ink container 12 and the printer portion 18 is to ensure the operation of the printer portion 18 is compatible with the ink contained within the replaceable ink container 12 thereby achieving high print quality and reliable operation of the printing system 10.

The controller 29, among other things, controls the transfer of information between the printer portion 18 and the replaceable ink container 12. In addition, the controller 29 controls the transfer of information between the printhead 16 and the controller 29 for activating the printhead to selectively deposit ink on print media. In addition, the controller 29 controls the relative movement of the printhead 16 and print media. The controller 29 performs additional functions such as controlling the transfer of information between the printing system 10 and a host device such as a host computer (not shown).

Figure 3:
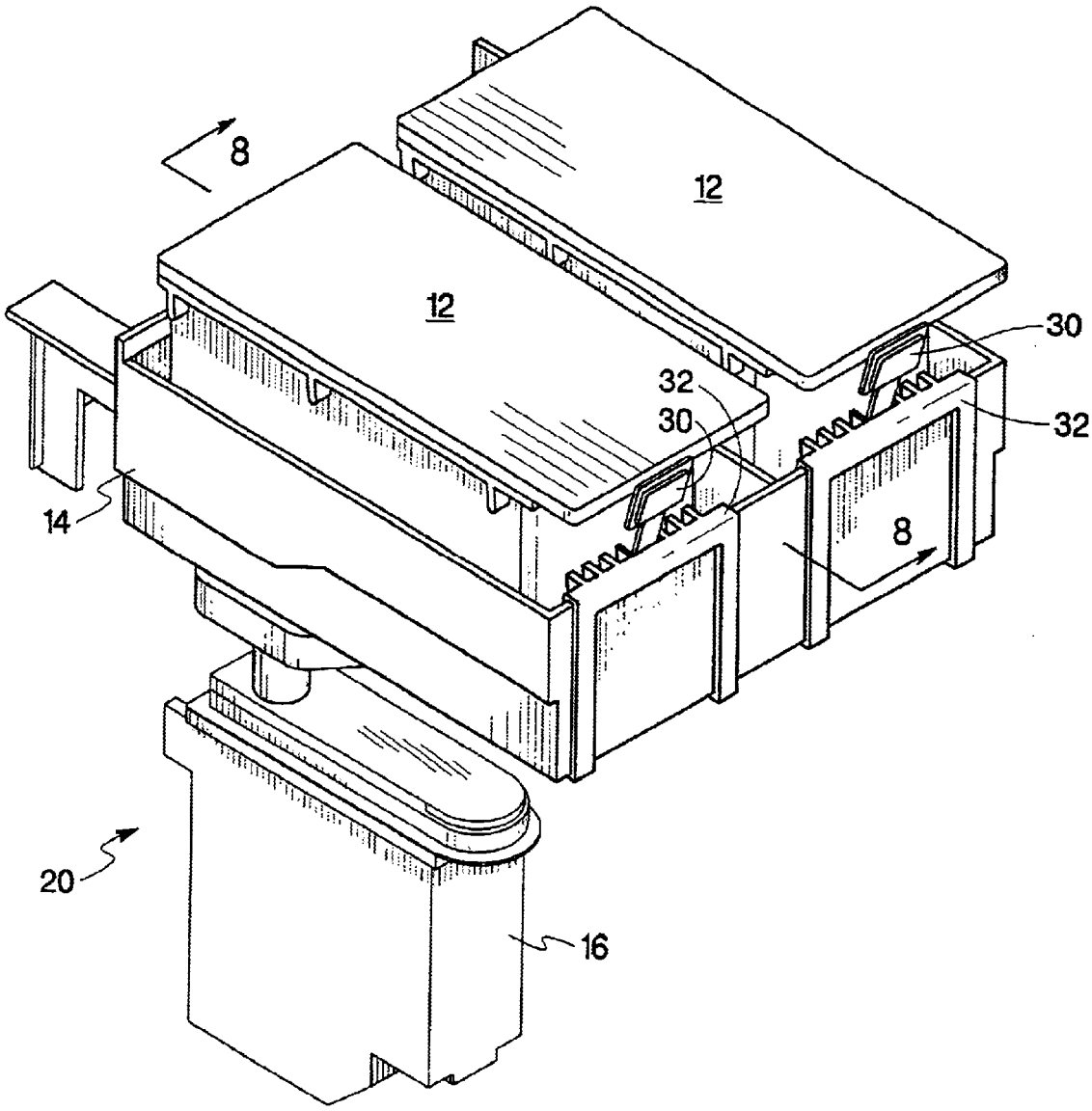
FIG. 3 is a greatly enlarged perspective view of a portion of a scanning carriage showing the replaceable ink containers of the present invention positioned in a receiving station that provides fluid communication between the replaceable ink containers and one or more printhead.

FIG. 3 is a perspective view of a portion of the scanning carriage 20 showing a pair of replaceable ink containers 12 properly installed in the receiving station 14. An inkjet printhead 16 is in fluid communication with the receiving station 14. In an exemplary embodiment, the inkjet printing system 10 includes a tricolor ink container containing three separate ink colors and a second ink container containing a single ink color. In this embodiment, the tri-color ink container contains cyan, magenta, and yellow inks, and the single color ink container contains black ink for accomplishing four-color printing. The replaceable ink containers 12 can be partitioned differently to contain fewer than three ink colors or more than three ink colors if more are required. For example, in the case of high fidelity printing, frequently six or more colors are used to accomplish printing.

In an exemplary embodiment, four inkjet print printheads 16, one printhead 16 for printing black ink, and three printheads 16 for printing cyan, magenta and yellow, are each fluidically coupled to the receiving station 14. In this exemplary embodiment, each of the four printheads is fluidically coupled to one of the four colored inks contained in the replaceable ink containers. Thus, the cyan, magenta, yellow and black printheads 16 are each coupled to their corresponding cyan, magenta, yellow and black ink supplies, respectively. Other configurations which make use of fewer printheads than four are also possible. For example, the printheads 16 can be configured to print more than one ink color by properly partitioning the printhead 16 to allow a first ink color to be provided to a first group of ink nozzles and a second ink color to be provided to a second group of ink nozzles, with the second group of ink nozzles different from the first group. In this manner, a single printhead 16 can be used to print more than one ink color allowing fewer than four printheads 16 to accomplish four-color printing.

In another exemplary embodiment, four printheads each with a printhead can be employed, with four replaceable ink containers, and with each cartridge fluidically coupled to one of the four colored inks contained in the replaceable ink containers. Thus, for this alternate embodiment, the cyan, magenta, yellow and black printheads are each coupled to their corresponding cyan, magenta, yellow and black ink supplies, respectively.

The scanning carriage portion 20 shown in FIG. 3 is shown fluidically coupled to a single printhead 16 for simplicity. Each of the replaceable ink containers 12 includes a latch 30 for securing the replaceable ink container 12 to the receiving station 14. The receiving station 14 in the preferred embodiment includes a set of keys 32 that interact with corresponding keying features 84 on the trailing end 82 of the replaceable ink container 12 (see FIG. 6). The keying features 10 on the replaceable ink container 12 interact with the keys 32 on the receiving station 14 to ensure that the replaceable ink container 12 is compatible with the receiving station 14.

Figure 4:
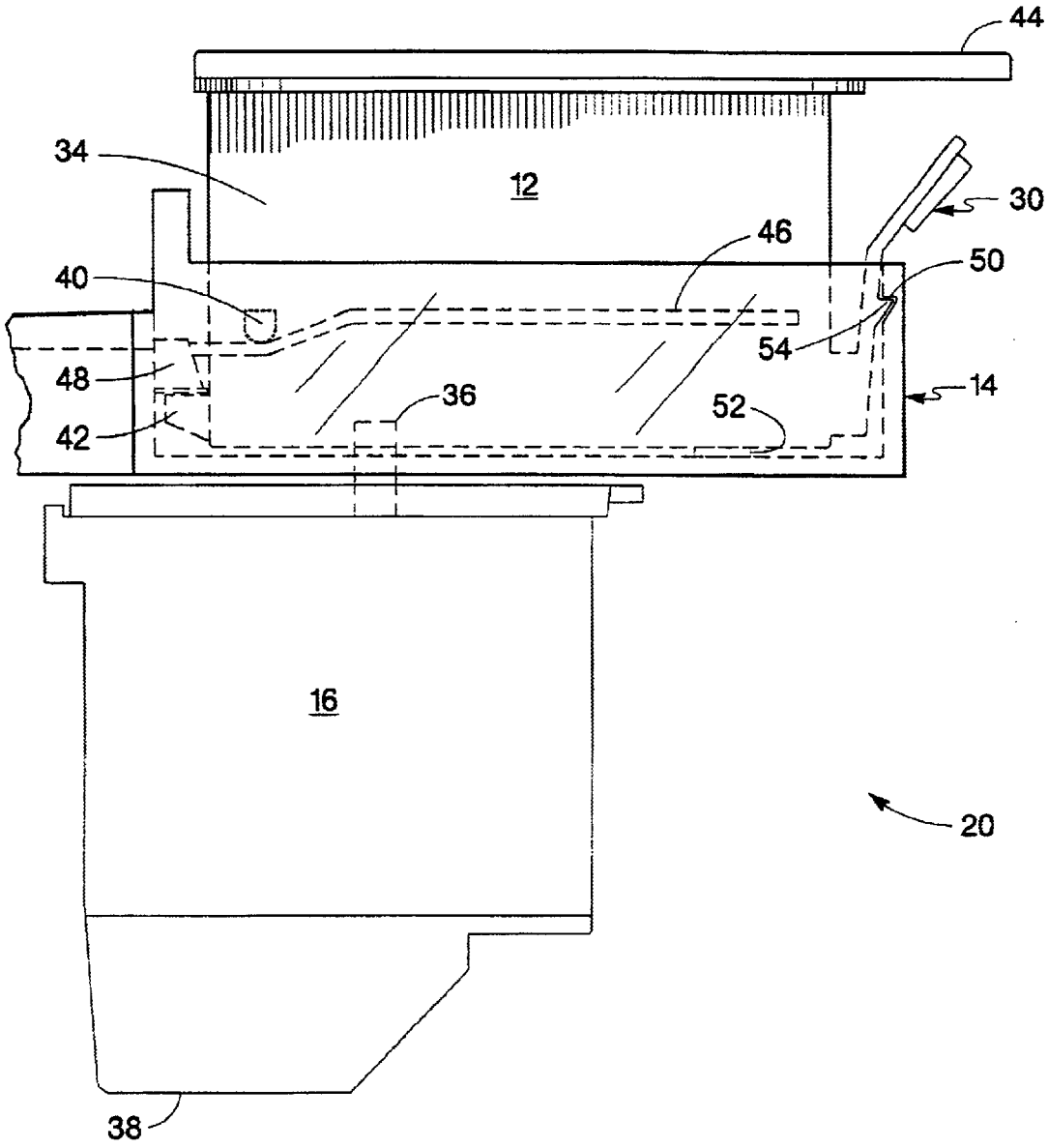
FIG. 4 is a side plan view of a portion of the scanning carriage.

FIG. 4 is a side plan view of the scanning carriage portion 20 shown in FIG. 2. The scanning carriage portion 20 includes the ink container 12 shown properly installed into the receiving station 14, thereby establishing fluid communication between the replaceable ink container 12 and the printhead 16.

The replaceable ink container 12 includes a reservoir portion 34 for containing one or more quantities of ink. In the preferred embodiment, the tri-color replaceable ink container 12 has three separate ink containment reservoirs, each containing ink of a different color. In this preferred embodiment the monochrome replaceable ink container 12 is a single ink reservoir 34 for containing ink of a single color.

In the preferred embodiment, the reservoir 34 has a capillary storage member 90 (FIGS. 8–9) disposed therein. The capillary storage member 90 is a porous member having sufficient capillarity to retain ink to prevent ink leakage from the reservoir 34 during insertion and removal of the ink container 12 from the printing system 10. This capillary force is sufficiently great to prevent ink leakage from the ink reservoir 34 over a wide variety of environmental conditions such as temperature and pressure changes. In addition, the capillary of the capillary member is sufficient to retain ink within the ink reservoir 34 for all orientations of the ink reservoir as well as a reasonable amount of shock and vibration the ink container may experience during normal handling. The preferred capillary storage member is a network of heat bonded polymer fibers described in U.S. patent application entitle "Ink Reservoir for an Inkjet Printer" filed on Oct. 29, 1999, Ser. No. 09/430,400, assigned to the assignee of the present invention and incorporated herein by reference. Other types of capillary material could alternatively be employed, such as foam.

Once the ink container 12 is properly installed into the receiving station 14, the ink container 12 is fluidically coupled to the printhead 16 by way of fluid interconnect 36. Upon activation of the printhead 16, ink is ejected from the printhead 16 producing a negative gauge pressure, sometimes referred to as backpressure, within the printhead 16. This negative gauge pressure within the printhead 16 is sufficient to overcome the capillary force resulting from the capillary member disposed within the ink reservoir 34. Ink is drawn by this backpressure from the replaceable ink container 12 to the printhead 16. In this manner, the printhead 16 is replenished with ink provided by the replaceable ink container 12.

The fluid interconnect 36 is preferably an upstanding ink pipe that extends upwardly into the ink container 12 and downwardly to the inkjet printhead 16. The fluid interconnect 36 is shown greatly simplified in FIG. 4. In the preferred embodiment, the fluid interconnect 36 is a manifold that allows for offset in the positioning of the printheads 16 along the scan axis, thereby allowing the printhead 16 to be placed offset from the corresponding replaceable ink container 12. In the preferred embodiment, the fluid interconnect 36 extends into the reservoir 34 to compress the capillary member, thereby forming a region of increased capillarity adjacent the fluid interconnect 36. This region of increased capillarity tends to draw ink toward the fluid interconnect 36, thereby allowing ink to flow through the fluid interconnect 36 to the printhead 16. The ink container 12 is properly positioned within the receiving station 14 such that proper compression of the capillary member is accomplished when the ink container 12 is inserted into the receiving station. Proper compression of the capillary member establishes a reliable flow of ink from the ink container 12 to the printhead 16.

The replaceable ink container 12 further includes a guide feature 40, an engagement feature 42, a handle 44 and a latch feature 30 that allow the ink container 12 to be inserted into the receiving station 14 to achieve reliable fluid interconnection with the printhead 16 as well as form reliable electrical interconnection between the replaceable ink container 12 and the scanning carriage 20.

In this exemplary embodiment, the receiving station 14 includes a guide rail 46, an engagement feature 48 and a latch engagement feature 50. The guide rail 46 cooperates with the guide rail engagement feature 40 and the replaceable ink container 12 to guide the ink container 12 into the receiving station 14. Once the replaceable ink container 12 is fully inserted into the receiving station 14, the engagement feature 42 associated with the replaceable ink container engages the engagement feature 48 associated with the receiving station 14, securing a front end or a leading end of the replaceable ink container 12 to the receiving station 14. The ink container 12 is then pressed downward to compress a spring biasing member 52 associated with the receiving station 14 until a latch engagement feature 50 associated with the receiving station 14 engages a hook feature 54 associated with the latch member 30 to secure a back end or trailing end of the ink container 12 to the receiving station 14.

Figure 5:
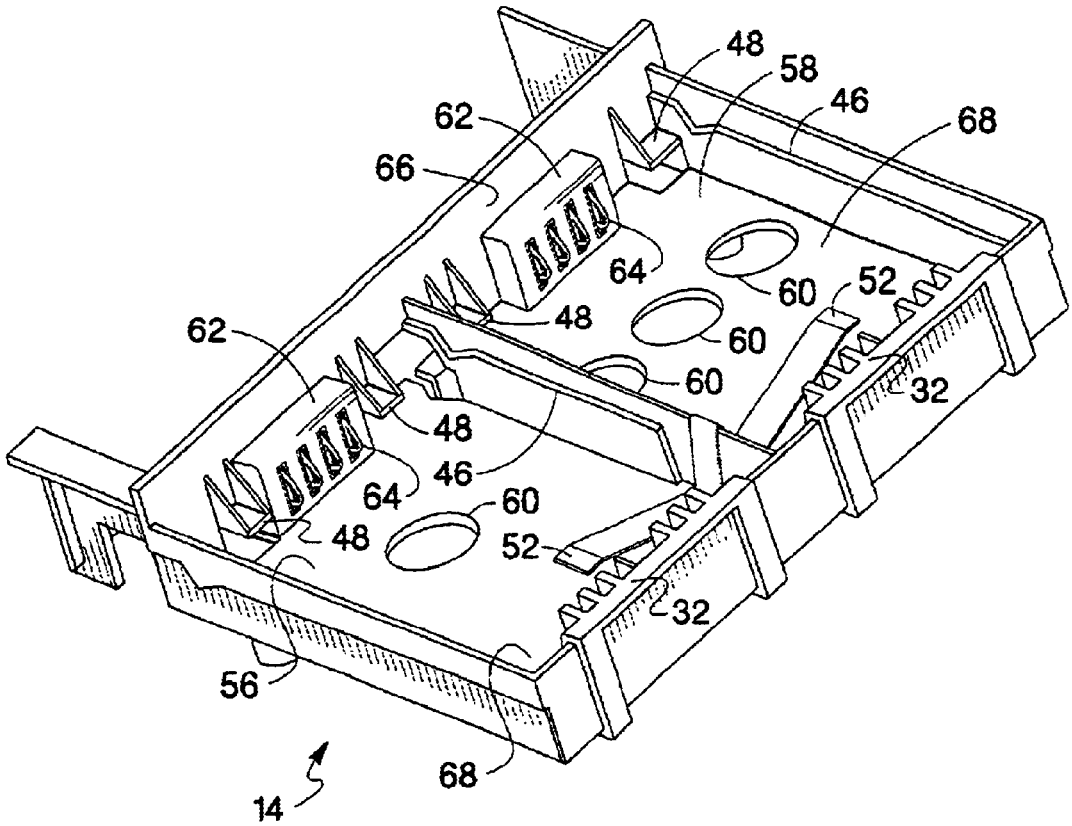
FIG. 5 illustrates in isolation a receiving station for receiving one or more replaceable ink containers of the present invention.

FIG. 5 is a front perspective view of the receiving station 14 shown in isolation. The receiving station 14 shown in FIG. 5 includes a monochrome bay 56 for receiving an ink container 12 containing a single ink color and a tri-color bay 58 for receiving an ink container having three separate ink colors contained therein. In this preferred embodiment, the monochrome bay 56 receives a replaceable ink container 12 containing black ink, and the tri-color bay receives a replaceable ink container 12 containing cyan, magenta, and yellow inks, each partitioned into a separate reservoir within the ink container 12. The receiving station 14 as well as the replaceable ink container 12 can have other arrangements of bays 56 and 58 for receiving ink containers containing different numbers of distinct inks contained therein. In addition, the number of receiving bays 56 and 58 for the receiving station 14 can be fewer or greater than two. For example, a receiving station 14 can have four separate bays for receiving four separate monochrome ink containers 12 with each ink container containing a separate ink color to accomplish four-color printing.

Each bay 56 and 58 of the receiving station 14 includes an aperture 60 in the bottom wall 68 for receiving each of the upright fluid interconnects 36 that extend there through. The fluid interconnect 36 is a fluid inlet for ink to exit a corresponding fluid outlet associated with the ink container 12. An electrical interconnect 62 is also included on the back wall 66 in each receiving bay 56 and 58. The electrical interconnect 62 includes a plurality of electrical contacts 64. In the preferred embodiment, the electrical contacts 64 are an arrangement of four spring-loaded electrical contacts that engage a plurality of electrical contacts 78 of the ink container 12 with proper installation of the replaceable ink container 12 into the corresponding bay of the receiving station 14.

The receiving station 14 shown in FIG. 5 is simplified and does not show detail of the fluid interconnect 36. A separate fluid interconnect 36 extends through each aperture 60 to provide fluidic coupling between the ink container 12 and the corresponding printhead 16. The fluidic interconnect 36 is shown in more detail in FIGS. 8, 9, 10*a* and 10*b*.

Figure 6:
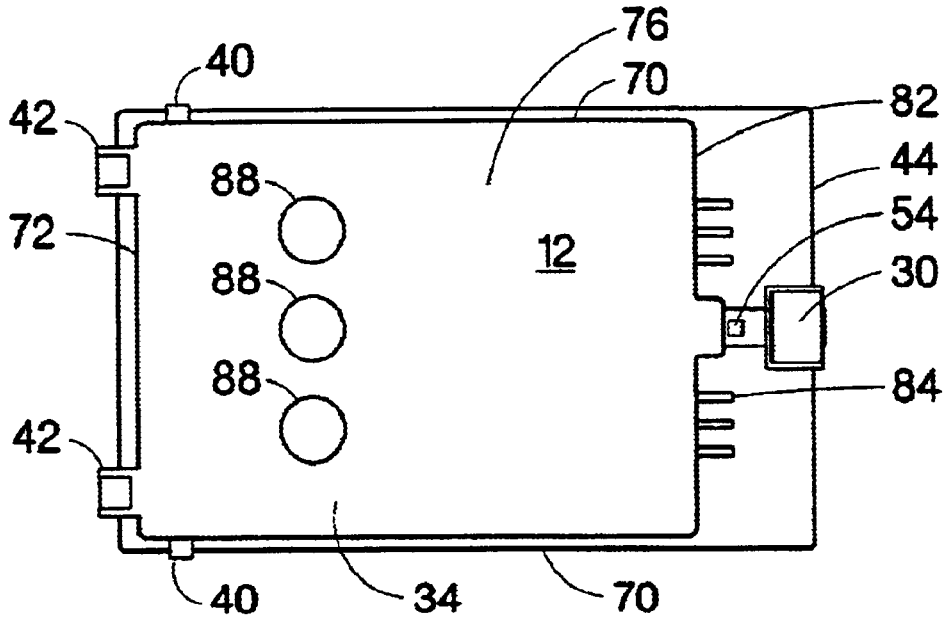
FIG. 6 is a bottom view of a three-color replaceable ink container of the present invention shown in isolation.

FIG. 6 is a bottom view of a three-color replaceable ink container 12 of the present invention shown in isolation. The replaceable ink container includes a pair of outwardly projecting guide rail engagement features 40. In the preferred embodiment, each of these guide rail engagement features 40 extend outwardly in a direction orthogonal to upright side 70 of the replaceable ink container 12. The engagement feature 42 extend outwardly from a front surface or leading edge 72 of the ink container 12. The engagement features 42 are disposed on either side of an electrical interface 74 and are disposed toward a bottom surface 76 of the replaceable ink container 12. The electrical interface 74, shown in FIG. 7, includes a the plurality of electrical contacts 78, with each of the electrical contacts 78 electrically connected to an electrical storage device 80.

Once the ink container 12 is installed into the printing system 10 and fluidically coupled to the printhead by way of fluid interconnect 36, the capillary storage member 90 should allow ink to flow from the ink container 12 to the ink jet printhead 16. As the printhead 16 ejects ink, a negative gauge pressure, sometimes referred to as a backpressure, is created in the printhead 16. This negative gauge pressure within the printhead 16 should be sufficient to overcome the capillary force retaining ink within the capillary member 90, thereby allowing ink to flow form the ink container 12 into the printhead 16 until equilibrium is reached. Once equilibrium is reached and the gauge pressure within the printhead 16 is equal to the capillary force retaining ink within the ink container 12, ink no longer flows from the ink container to the printhead 16. The gauge pressure in the printhead 16 will generally depend on the rate of ink ejection from the printhead 16. As the printing rate or ink ejection rate increases, the gauge pressure within the printhead will become more negative, causing ink to flow at a higher rate to the printhead 16 from the ink container 12.

In one preferred inkjet printing system 10 the printhead 16 produces a maximum backpressure that is equal to 10 inches of water or a negative gauge pressure that is equal to 10 inches of water. The maximum backpressure will depend on the particular printhead used in the system. As the backpressure increases, the size of the ink droplets ejected by the printhead 16 becomes smaller, leading eventually to print quality problems, and ultimately to depriming, when air is pulled through the printhead nozzles. The smaller the nozzle size, the higher will be the backpressure tolerated by the printhead before the print quality issues are typically encountered. Thus, for an exemplary form of thermal inkjet printhead, depriming of a black ink printhead typically occurs at a backpressure of about 19 inches of water, and print quality issues arise at a backpressure of about 8 inches of water. For an exemplary color ink printhead, which typically has smaller nozzles than a black ink printhead, depriming occurs at a backpressure about 30 inches of water, and print quality issues arise at a backpressure of about 12 inches of water.

Figure 7:
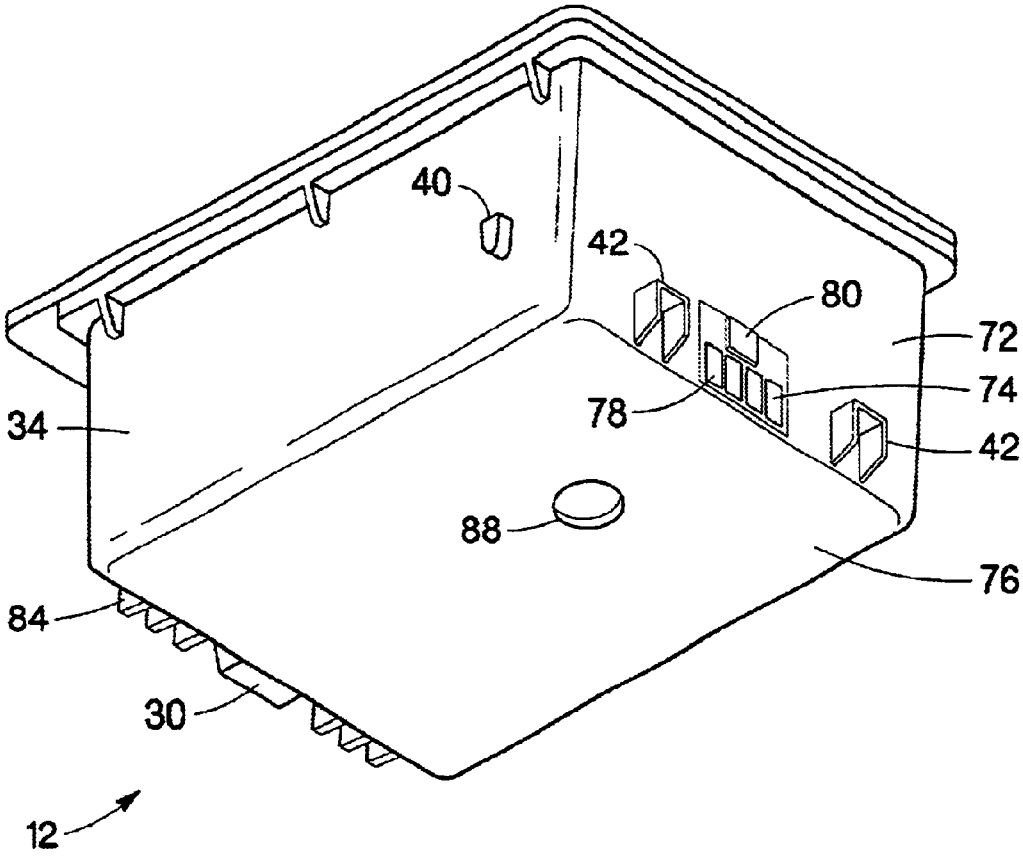
FIG. 7 is a perspective view of a single color replaceable ink container of the present invention.

FIG. 7 is a perspective view of a monochrome or single color replaceable ink container 12 of the present invention. The monochrome ink container 12 is similar to the tri-color ink container 12 shown in FIG. 6 except that only a single ink color is contained therein instead of three separate ink colors contained with the tri-color ink container 12.

Figure 8:
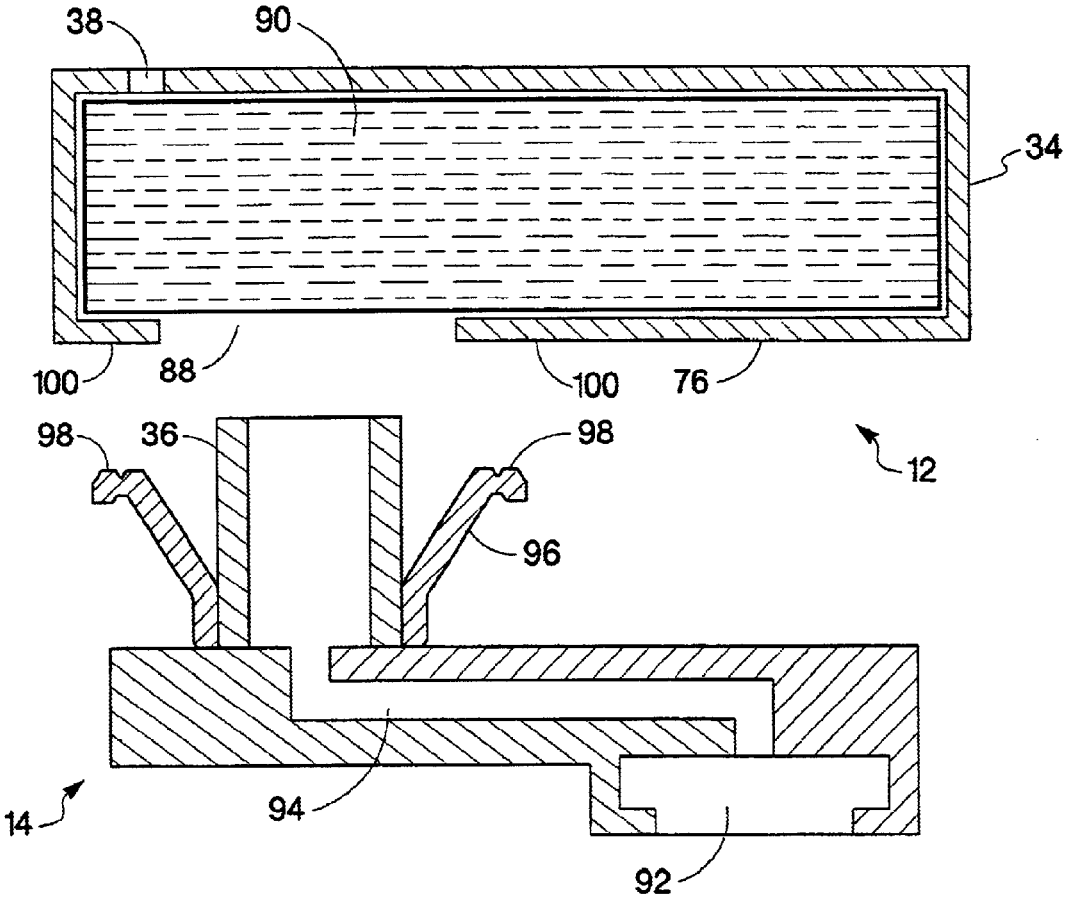
FIG. 8 is a cross-sectional view taken along line 8—8 of FIG. 3, illustrating in further detail the ink container, comprising the reservoir portion containing the sealing material and a sealing surface on the receiving station.

FIG. 8 is a cross-sectional view taken along line 8—8 of FIG. 3, illustrating in further detail the ink container 12, comprising the reservoir portion or containment vessel 34, with the reservoir material 90 disposed therein. The ink container 12 is shown positioned for connection with the fluid interconnect 36 on the ink container receiving station 14 for illustrative purposes.

The ink container receiving station 14 includes the fluid interconnect 36 for establishing fluid coupling to the ink container 12 and a fluid interconnect 92 for establishing fluid coupling with the corresponding printhead 16 and a fluid coupling 94 in fluid communication with each of the fluid interconnects 36 and 92. Once the ink container 12 is properly inserted into the receiving station 14, the fluid interconnect 36 extends into the reservoir 34 to compress the capillary member 90 and establish fluid communication between the ink container 12 and the printhead 16.

The ink container receiving station 14 also includes a sealing structure 96 to provide a seal between the ink container 12 and the receiving station 14. The sealing structure 96 tends to limit evaporation of volatile ink components such as water within the ink container 12 once the ink container 12 is properly installed into the receiving station 14. In addition, the sealing structure 96 tends to prevent contamination of the ink provided to the printhead 16. In one preferred embedment, the sealing structure 96 is a circumferential structure that is formed from a resilient material. As the ink container 12 is inserted into the receiving station 14, the sealing structure 96 engages a sealing surface 100 proximate the fluid outlet 88 of the ink container to form a seal between the sealing structure 96 and the ink container 12. The seal is established by a sealing surface 98 associated with the sealing structure 96 engaging the sealing surface 100 associated with the ink container 12.

In one exemplary embodiment, the sealing structure 96 is attached to the fluid interconnect 36 so that once the ink container 12 is properly inserted into the receiving station 14, the sealing structure 96 forms a seal between the sealing surface 100 on the ink container 12 and the outer circumference of the fluid interconnect 36. In this manner, exposure of ink to the atmosphere is greatly reduced, tending to limit the evaporation of volatiles within the ink container 12.

Figure 9:
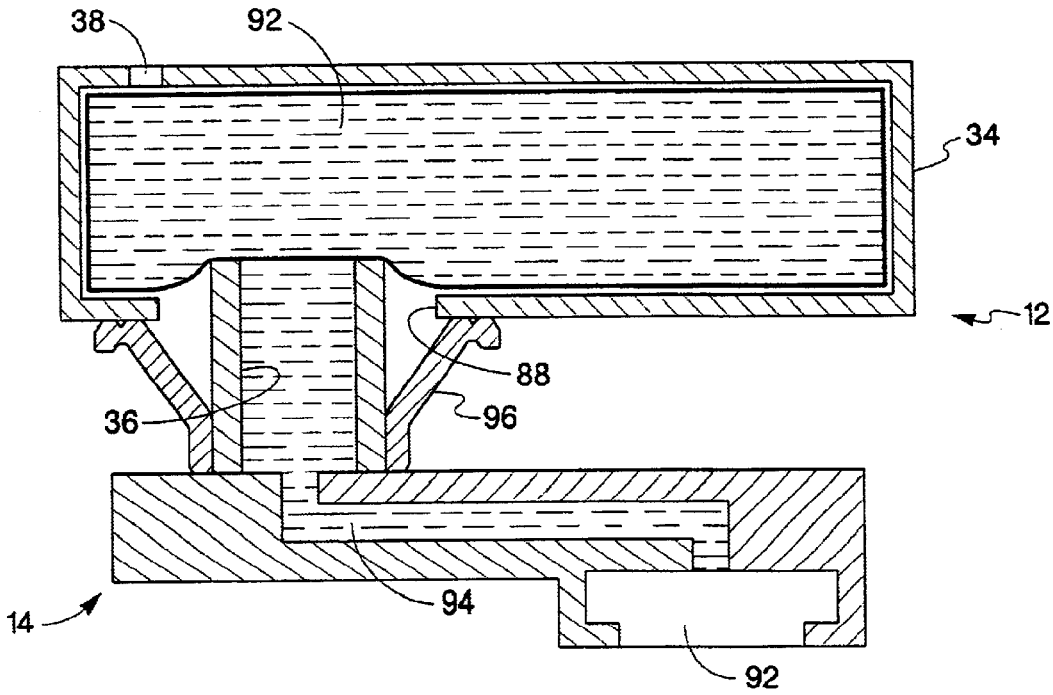
FIG. 9 is a cross-sectional view, similar to FIG. 8 but showing the sealing surface in engagement with the ink container.

FIG. 9 shows the ink container 12 properly inserted into the receiving station 14 such that ink flow between the ink container 12 and the fluid interconnect 36 is established. The sealing structure 96 is shown engaged with the sealing surface 100 on the ink container 12 to form a seal around the fluid outlet 88 of the ink container 12 for limiting the evaporation of volatiles within the ink. The seal is formed by opposing surfaces on the sealing structure 96 that engage with the sealing surface 100 on the ink container 12 to form a face seal therebetween.

The ink reservoir 34 in the preferred embodiment includes a vent 38 for equalizing pressure within the reservoir 34 to allow the extraction of ink from the ink container 12. The vent 38 is preferably formed to limit evaporation of volatiles within the ink. In one preferred embodiment, the vent 38 is formed by using a labyrinth for minimizing air entry while providing pressure equalization within the ink container 12 so that ink can be extracted from the ink container 12 without building up excessive backpressure. The use of a labyrinth greatly reduces volatile loss in the ink due to the vent 38. Therefore, it is important that the sealing structure 96 properly seal to limit volatiles within the ink from escaping.

The sealing structure 96 in one exemplary embodiment is formed of a resilient material such as elastomeric structure such as Ethylene-Propylene-Diene monomer/butyl blend (EPDM/buytyl). Alternatively, the sealing structure 96 includes a spring that is compressed as the ink container 12 is inserted into the receiving station 14 so that the spring urges the sealing structure 96 against the ink container 12 to establish a seal between the ink container 12 and the receiving station 14 to prevent evaporation of volatiles within the ink. An exemplary form of the sealing structure 96 with a spring is described in co-pending application Ser. No. 09/651,682, filed Aug. 30, 2000, LONG-LIFE SPRING-BACKED FLUID INTERCONNECT SEAL.

Figure 10A:
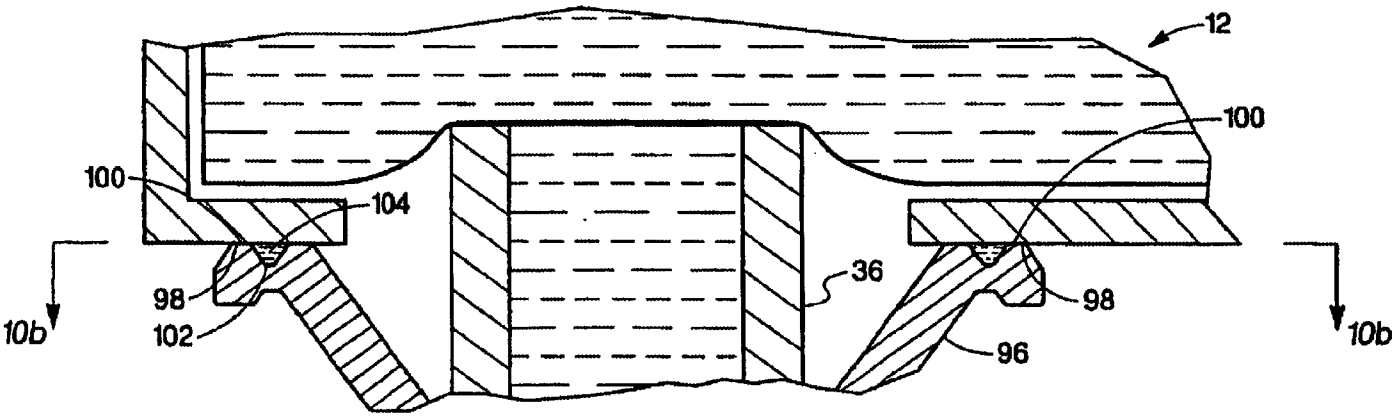
FIG. 10*a* is a greatly enlarged cross-sectional view of FIG. 8 but showing the sealing material disposed between sealing surface and the ink container.

FIG. 10*a* is a greatly enlarged view of the sealing structure 96 in engagement with the outer surface of the ink container 12 shown in FIG. 9. In one preferred embodiment, the sealing surface 98 of the sealing structure 96 includes an annular groove 102 formed therein. The annular groove 102 is configured to retain a sealing material 104 provided by the ink container 12. In the preferred embodiment, the sealing material 104 provided by the ink container is an ink having suspended particles therein. As the ink within the annular groove dries, the suspended particles come out of suspension and solidify to seal any defects between the sealing surfaces 98 and 100. In an exemplary embodiment, the sealing material is a pigmented ink having suspended carbon black particles therein. Pigmented ink such as this exemplary pigmented ink is described in detail in U.S. Pat. No. 5,085,698.

To encourage the sealing material to enter the annular groove 102, the sealing surface 100 on the ink container 12 can be formed to be highly wettable. Surfaces that are highly wettable tend to draw sealing material to the sealing surface 100. Alternatively, various mechanical features such as capillary structures can be formed in the ink container 12 to draw ink to the annular surface so that the surface between the sealing structure 96 and the ink container 12 are wetted to seal defects there between.

Figure 10B:
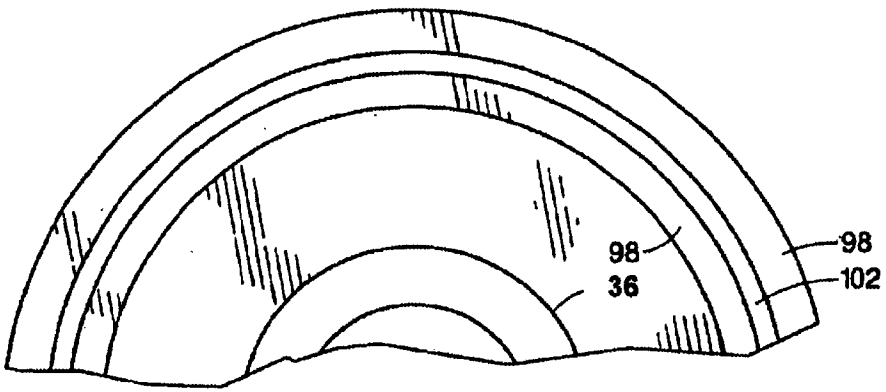
FIG. 10*b* is a sectional view taken across lines 10*b*—10*b* shown in FIG. 10*a*.

FIG. 10*b* is a cross-section taken across lines 10*b* to show the sealing surface 98 of the sealing structure 96 shown partially broken away. In one preferred embodiment, the annular groove 102 is formed within the sealing surface 98 to retain the sealing material 104. Retaining sealing material 104 within the groove 102 ensures sealing material 104 is present to seal defects that exist along the entire continuum of the seal surface. Defects along the seal surface may be the result of molding defects that can produce irregularities in the seal surface, or contamination on the seal surface. Be sealing defects with the sealing material 104 the seal between the sealing surface 98 and the sealing surface 100 is improved.

Figure 11:
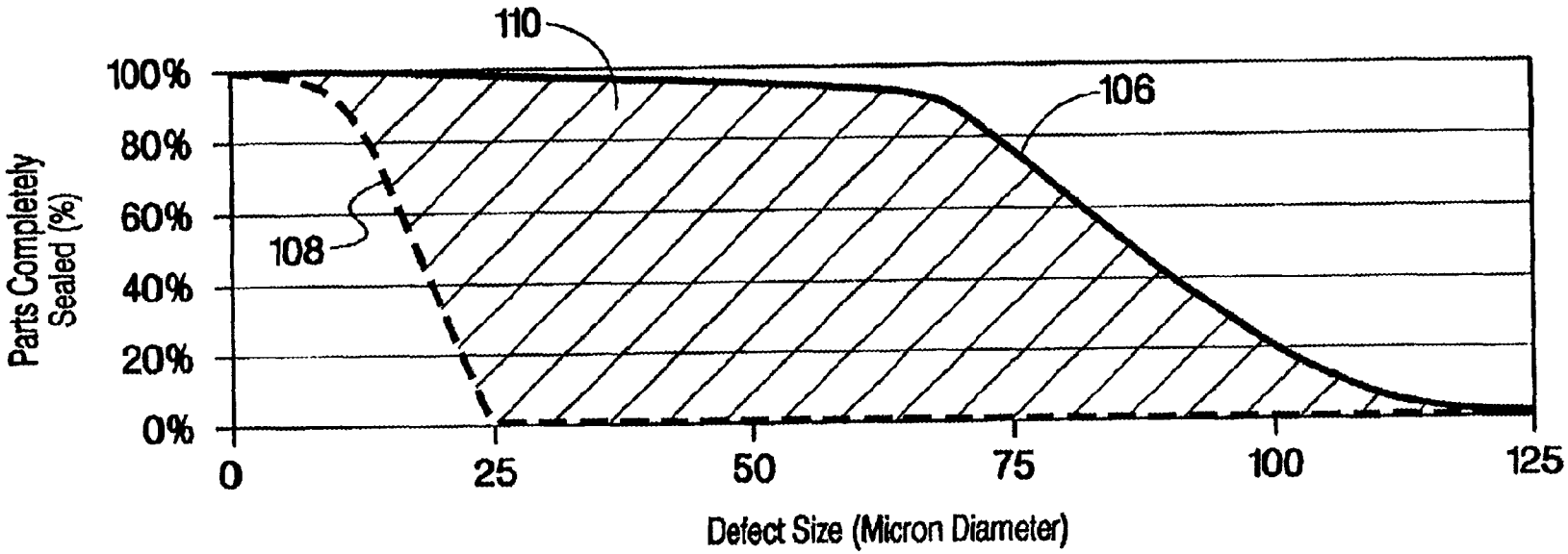

FIG. 11 is graphical representation showing the defect size versus percent of sealing for the seal between the ink container 12 and fluid interconnect 36 with and without the use of the sealant for sealing defects of the present invention. The sealing ability of a face seal such as shown in FIG. 10*a* between the sealing surface 98 and the sealing surface 100 using pigmented ink as a sealant is represented by curve 106. The sealing ability of the same face seal but without the use of the sealing material is represented buy curve 108 shown in dashed lines. Without the use of the sealing material no seal is formed when the defect is greater than 25 microns. In contrast, the use of pigmented ink as a sealant allows a seal to be at least partially formed for defects less than 125 microns. The crosshatched portion 110 between curves 106 and 108 represents an improvement in sealing using the technique of the present invention. Pigmented ink is an effective sealant for surface seals such as face seals. The use of pigmented ink as a sealing material tends to allow the system to be self-sealing and is especially effective for defects that are of smaller size.

The present invention provides an improved seal for preventing the loss of volatiles such as water from ink within the ink container and the entire ink delivery system. This improved seal makes use of the unique properties of pigmented ink to seal any imperfections at the seal surface. The improved seal of the present invention allows the seal to be a relatively inexpensive face seal thereby tending to reduce the overall costs of the printing system. In addition, the sealing technique of the present invention makes for relatively easy insertion and removable requirements thereby tending to reduce the costs and size of the receiving station. Finally, by preventing the loss of volatiles from the ink, the reliability of the printing system is improved as well as the quality of the printed images.

The present invention has been discussed with respect to the use of sealing material to improve the robustness of the seal between the ink container 12 and the receiving station 14. The technique of the present invention is suitable for sealing other fluid seals in the ink delivery system as well. For example, a similar seal arrangement can be used between the printhead 16 and the fluid interconnect 92 as the seal arrangement used between the ink container 12 and the fluid interconnect 36. The sealing material of the present invention can be used to seal defects present in the seal between the printhead 16 and the fluid interconnect 92.

What is claimed is:

1. A replaceable ink container for providing ink to an inkjet printing system, the inkjet printing system having a receiving station for receiving the replaceable ink container, the receiving station having a fluid inlet and a sealing structure around the fluid inlet, the replaceable ink container comprising:

a reservoir defining a fluid outlet and a sealing surface configured for engaging the sealing structure proximate the fluid outlet, wherein the fluid outlet is configured to allow passage of the fluid inlet into the reservoir, and wherein the engaged sealing surface and sealing structure define a groove therebetween; and a sealing material contained within the reservoir for wetting the sealing surface, the sealing material including solid particles held in a suspension, solidification of the solid particles at least partially in the groove between the sealing surface and the sealing structure acting to seal defects between the sealing surface and the sealing structure.

2. The replaceable ink container of claim 1 wherein the solid particles are pigment particles.

3. The replaceable ink container of claim 1 wherein the solid particles are carbon black particles.

4. The replaceable ink container of claim 1 wherein the suspension is a dispersant.

5. The replaceable ink container of claim 1 wherein the sealing material contained within the reservoir is a quantity of ink.

6. The replaceable ink container of claim 1 wherein the sealing surface is configured to be sufficiently wettable such that the sealing surface is wet by the sealing material.

7. A method for forming a seal between a replaceable ink container and a sealing structure, the method comprising:

wetting a sealing surface around a fluid outlet on the replaceable ink container with a sealing material defined by solid particles held in a suspension which is contained within the replaceable ink container;

receiving a fluid inlet through the fluid outlet;

engaging the sealing surface with a sealing structure whereby the sealing material is disposed there between; and solidifying the sealing material at least partially in a groove in the sealing structure so that the solid particles fall out of the suspension and seal defects between the sealing surface and the sealing structure.

8. The method of claim 7 wherein the sealing material is an ink contained within the replaceable ink container.

9. A replaceable ink container for providing ink to an inkjet printing system, the inkjet printing system having a receiving station for receiving the replaceable ink container, the receiving station having a fluid inlet and a sealing structure, the replaceable ink container comprising:

a storage reservoir having a capillary storage material disposed therein for retaining ink, the storage reservoir defining a fluid outlet and a sealing surface configured for engaging the sealing structure proximate the fluid outlet, wherein the fluid outlet is configured to allow passage of the fluid inlet into the storage reservoir, and wherein the engaged sealing surface and sealing structure define a groove therebetween; and an ink retained within the capillary storage material, the ink having particles suspended therein, the particles solidifying at least partially in the groove between the sealing surface and the sealing structure to seal defects between the sealing surface and the sealing structure.

10. The replaceable ink container of claim 9 wherein the particles are pigment particles.

11. The replaceable ink container of claim 9 wherein the particles are carbon black particles.

12. The replaceable ink container of claim 9 wherein the ink further includes a dispersant.

13. The replaceable ink container of claim 9 wherein the sealing surface proximate the fluid outlet is configured to be wetted by the ink stored within the ink container.

14. The replaceable ink container of claim 9 wherein the sealing surface is configured for enhanced wettability such that the sealing surface is wet by the ink.

15. A replaceable printing component for an inkjet printing system configured for receiving the replaceable printing component, the inkjet printing system having a fluid inlet and a sealing structure, the replaceable printing component comprising:

a fluid outlet configured to allow passage of the fluid inlet therethrough;

a sealing surface configured for engaging a corresponding sealing structure on the inkjet printing system and defining a groove between the engaged sealing surface and sealing structure; and wherein the sealing surface is configured so that sealing material, defined by solid particles held in a suspension, wets the sealing surface so that solidification of the solid particles in the groove between the sealing surface and the corresponding sealing structure seals defects between the sealing surface and the corresponding sealing structure.

16. The replaceable printing component of claim 15 wherein the replaceable printing component is a replaceable ink container.

17. The replaceable printing component of claim 15 wherein the replaceable printing component is a replaceable printhead.

18. The replaceable printing component of claim 15 wherein sealing material is pigmented ink.

19. The replaceable printing component of claim 15 wherein the sealing surface engages the corresponding sealing structure on the inkjet printing system to form a face seal.

* * * * *